United States Patent [19]

Sjogren

[11] 4,120,487

[45] Oct. 17, 1978

[54] FUME HOOD FOR A MELT POT

[75] Inventor: Karl-Erik Sjogren, Sandared, Sweden

[73] Assignee: American Air Filter Company, Inc., Louisville, Ky.

[21] Appl. No.: 798,377

[22] Filed: May 19, 1977

[30] Foreign Application Priority Data

Dec. 20, 1976 [SE] Sweden ..... 7614284

[51] Int. Cl.[2] ..... F27B 14/02

[52] U.S. Cl. ..... 266/158; 266/240

[58] Field of Search ..... 98/115 R, 115 MV; 266/158, 159, 240, 242

[56] References Cited

U.S. PATENT DOCUMENTS

| | | | |
|---|---|---|---|
| 2,377,597 | 6/1945 | Wilson et al. | 266/159 |
| 2,606,016 | 8/1952 | Lindh et al. | 266/159 |

*Primary Examiner*—Gerald A. Dost
*Attorney, Agent, or Firm*—Jon C. Winger

[57] ABSTRACT

Apparatus for collecting and removing smoke and fumes from a melting furnace plant comprising a platform tiltably supported by stationary supporting members, the tilting axis being near one edge of the platform, a furnace fixedly mounted to the platform, said furnace having a furnace chamber open at the top and accessible through a charging orifice in the platform, said furnace having a pouring spout connected to the upper part of a side wall of the furnace and located near the tilting axis. A hood is pivotally supported by supporting members mounted to the platform and being angularly movable towards and away from a portion of the platform surrounding the charging orifice of the platform. The pivot axis of the hood is parallel with the tilting axis of the platform and extends at the same side of the furnace as the tilting axis. A pair of parallel wall members are arranged on the upper surface of said platform and extend at right angles to the tilting axis. The wall members extend from the edge of the platform along the platform and have a vertical extent with respect to the plane of the platform such that in any angular position of said hood, the hood together with the said wall members and with the upper surface of the platform define a cowl facing said charging orifice. A first air duct is mounted to said platform, and, a second air duct is stationary relative to the stationary supporting members for the platform. The first air duct has an inlet orifice connected to the cowl and an outlet orifice surrounding the tilting axis. The outlet orifice is connected to and freely rotatable with respect to an inlet orifice of the second air duct.

13 Claims, 10 Drawing Figures

FUME HOOD FOR A MELT POT

The invention relates to apparatus for collecting and removing smoke or fumes from a melting furnace plant of the type comprising a platform tiltably supported by stationary supporting members, the tilting axis being adjacent to one edge of the platform, an induction furnace rigidly connected to said platform, the furnace chamber of said induction furnace being open at the top and accessible through a charging orifice provided in said platform, said induction furnace having a pouring spout provided in the upper part of the side-wall of the furnace near the tilting axis.

With the present demands for a reasonably clean air within the plant as well as in the environment of the plant, it is no longer, as formerly, sufficient to provide roof vents allowing the smoke and fumes developed by the operation of the plant to escape into the environment. It is necessary to make provisions for catching the smoke and fumes as near the source as possible and removing them to a filter plant or dust separating plant, in which they are cleaned. The devices developed for this purpose have, however, presented practical disadvantages, as they are bulky and difficult to manage and therefore cause extra trouble in the operation of the furnace and other parts of the plant. A usual consequence of this is that the operating personnel neglects to operate the fume extracting device properly, in order to facilitate their work.

A principal object to the invention is to provide apparatus for collecting and removing smoke and fumes from a melting furnace plant of the type stated which demands a minimum of space and the functioning of which requires no extra measures or demands a minimum only of extra measures.

The features characterizing the new apparatus according to the invention are concisely specified in the appended claims.

The invention shall now be explained in more detail with reference to the appended drawings showing a furnace plant provided with an example of apparatus according to the invention for collecting and removing smoke and fumes.

Figure 1:
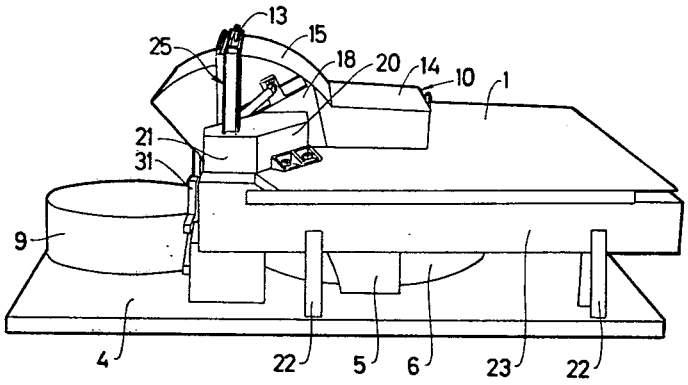
FIGS. 1–6 are perspective views of a model of the plant viewed from several directions and in several different situations.

The plant shown is provided with a working platform 1 pivotably supported by a pair of gudgeons 2 fitted each in one of a pair of stanchions 3 mounted on a base 4. The tilting axis of the platform determined by said gudgeons is near one edge of the platform. The working platform is provided with a pair of L-shaped frame members 5 the lower limbs of which are supported by the base 4 in the horizontal position of the platform. An induction furnace 6 provided with a cylindrical steel shell is supported between the frame members 5. The furnace chamber is accessible from above through a charging orifice 7 of the platform. The furnace is provided with a pouring spout 8 the tip of which is located at the tilting axis of the platform, so that said tip remains in substantially the same position at all angular positions of the platform. An operation station for the reception of the liquid metal discharged through the pouring spout at the tilting of the platform and the furnace (FIG. 10) is provided laterally of and below the tilting axis of the platform. In the model, said operation station is represented by a cylinder 9 mounted on the base 4, said cylinder corresponding actually to, for instance, a space for accommodating a ladle or a mold or to a machine for continuous casting.

Figure 7:
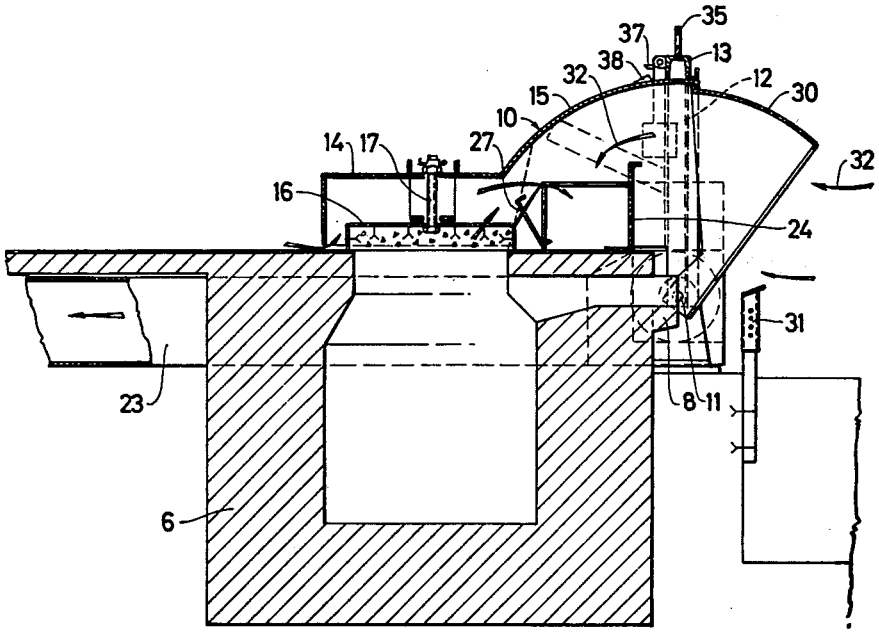
FIGS. 7–10 show a vertical section of the plant in four different operational situations.
Figure 10:
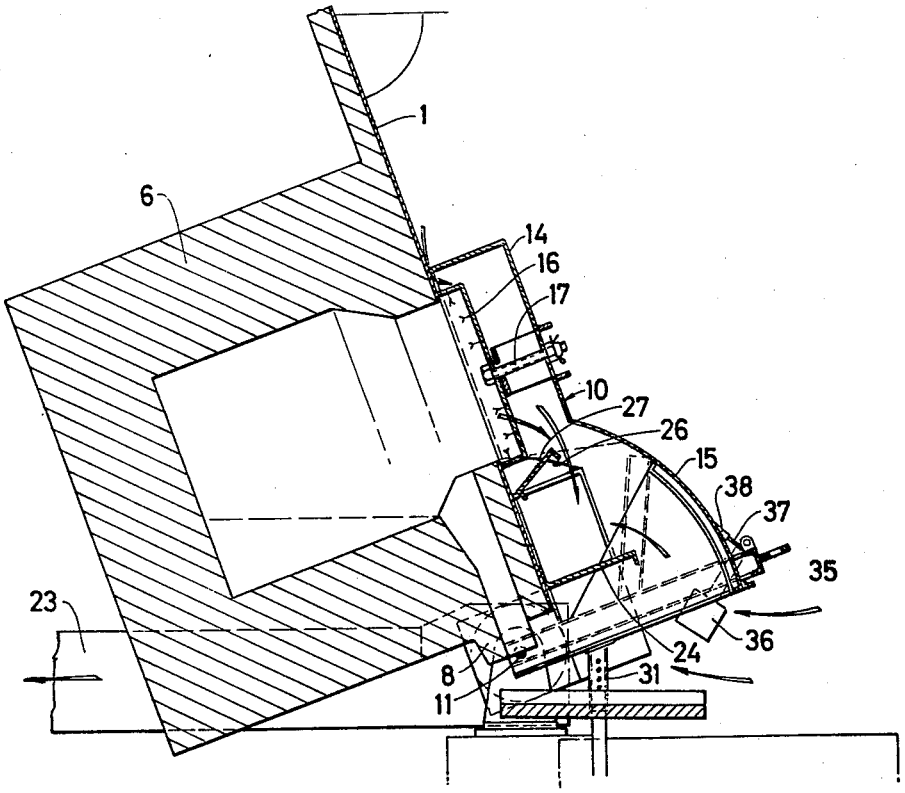

A hood 10 angularly displaceable with reference to the platform is provided for catching the smoke and the fumes developed by the furnace charge and by the molten metal discharged from the furnace. Said hood is pivotably supported by means of gudgeons 11 on a pair of girders 12 forming part of a frame 25 detachably attached to the platform. Said frame includes a yoke member 13 extending across the hood 10 and provided with an eye lug 35 for lifting the hood unit. The axis of said gudgeons approximately coincides with the tilting axis of the platform 1 determined by the gudgeons 2. The hood 10 comprises a box-shaped part 14 and a substantially cylinder sector shaped part 15 the axis of which coincides with the pivot axis of the hood determined by the gudgeons 11. Said cylinder sector shaped part 15 has plane, parallel side walls the width between which is substantially equal to the width between the corresponding side walls of the box-shaped part 14. The box-shaped part 14 in its bottom position covers the part adjacent to the charging orifice 7 of the surface of the platform and is provided on its inside with a lid 16 for the charging orifice. Said lid is supported by a bolt 17 so as to allow the lid to adapt itself freely to its support on the platform. The three edges of the box-shaped part 14 may in the bottom position of said part engage the platform or, as shown in FIGS. 7 and 10, by slightly spaced from the platform so that a narrow slot remains between the edge of the hood and the platform. The hood is arranged to be operated by a pair of compressed air cylinders 29, each of which is arranged between a bracket on the frame 25 and a bracket on the hood 10.

A pair of plane sheet metal members 18 attached to the frame 25 are parallel to each other and extend at right angles to the tilting axis of the platform, each of said sheet members being located at the outside of and closely spaced from one of the side walls of the cylinder sector shaped hood portion 15. Each of said sheet metal members has a straight lower edge close to the platform, an outer lateral edge at right angles to the plane of the platform and extending substantially radially with reference to the pivot axis of the hood, an upper edge forming part of a circle having the same radius as the cylinder sector shaped hood portion, and a straight inner edge, which in the example shown has such a position that a straight line extending between said inner lateral edges along the platform will be close to the edge of the charging orifice. One of said sheet metal members 18 is provided with a rectangular port 19 connected to one end of an air duct 20 attached to the frame 25 and detachably connected to the platform 1 together with said frame 25. The plane wall of the hood 10 adjoining the sheet member 18 just mentioned is provided with a recess 26 so as not to block the orifice 19 in the bottom position of the hood 10. The other end of the air duct extends downwards past the edge of the platform 1 adjacent to the tilting axis and is provided with a plane wall portion 21 having an orifice arranged concentrically to the tilting axis of the platform. A second air duct 23 attached to the base 4 by means of support members 22 is provided with an inlet orifice adapted to the outlet orifice of the air duct 20, said inlet orifice being provided in a wall portion parallel to the plane wall portion 21 and slideably engaging the same, so that the air ducts 20 and 23 communicate with each other in all angular positions of the platform 1. The air duct 23 is connected to a filtering plant (not shown) provided with a suction fan.

A baffle plate 24 the height of which exceeds the height of the port 19 in one of the sheet metal members 18 and the plane of which extends through the vertical edge of the port 19 which is nearest to the tilting axis is attached to the platform in the vicinity of the edge of the platform near the tilting axis, said baffle plate being parallel to said edge of the platform. A baffle strip 27 is secured between the plane walls of the hood 10 in such a position that the lower edge of said strip will be closely adjacent to the platform 1 in the bottom position of the hood and will be closely adjacent to the upper edge of the baffle plate 24 in the top position of the hood determined by the yoke member 13. The baffle strip 27 and the hood 10 are separated by a slot 28 at the transition between the box-shaped part 14 of the hood and the cylinder sector shaped part 15 of the hood.

The gudgeons 11 pivotably support, in addition to the hood 10, a second, substantially cylinder sector shaped hood 30 the radius and width of which are slightly less than those of the cylinder sector shaped part 15 of the hood 10, whereby the hood 30 can be angularly displaced into and out of the part 15 and in its outer positions forms an extension of the part 15. A pair of vertically adjustable stop members 31 supported by the base 4 co-operate each with one of the lateral edges of the hood 30 so as to limit the angular displacement of the hood 30 with reference to a vertical plane.

The frame 25 together with the sheet metal members 18, the air duct 20 and the hoods 10, 30 forms a unit which can be lifted off from the platform by means of the eye lug 35 when the attaching members (for instance screws or wedges) attaching said unit to the platform 1 have been unfastened. The joint between the air ducts 20 and 23 causes no difficulties in this operation, no part of one duct projecting into the other duct.

The operation of the platform 1 can be effected by any known or suitable means, for instance by means of a pair of hydraulic cylinders or by means of a pair of gear quadrants operated each by a motor-driven pinion.

Figure 2:
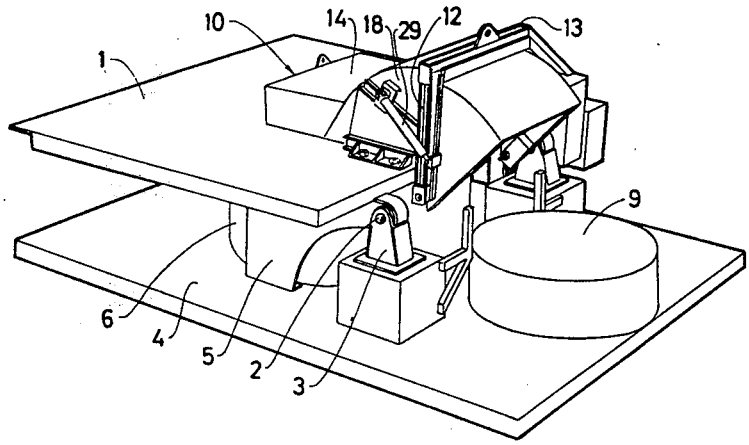

The operation of the plant shall now be shortly described. When a charge is being melted or held at a constant temperature the hood 10 is maintained in its lower position and the hood 30 is maintained in its outermost position (FIGS. 1, 2, 7). A current of air indicated by the arrows 32 in FIG. 7 flows through the hood 30 and the part 15 of the hood 10 towards the suction port 19 of the duct 20. Said current of air carries away the smoke and the fumes emerging through the pouring orifice of the furnace. The throttling action effected by the baffle plate 24 results in the maintaining of a faint vacuum in the hood part 14 with respect to the atmosphere, said vacuum preventing the smoke or fumes which may escape under the edge of the lid 16 from emerging into the furnace hall.

Figure 3:
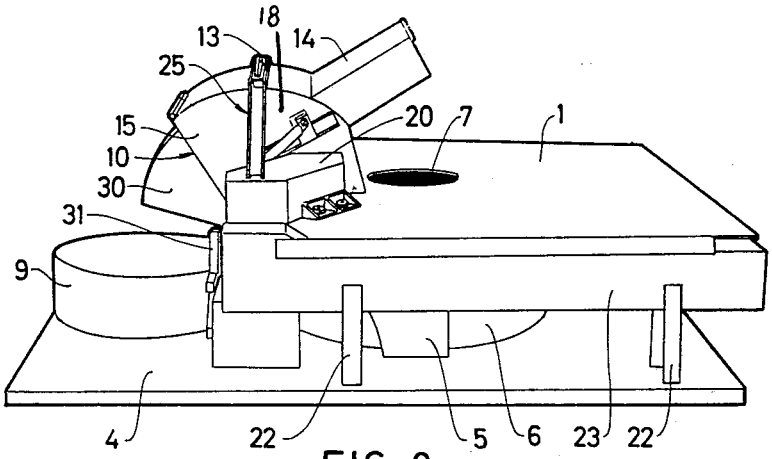
Figure 8:
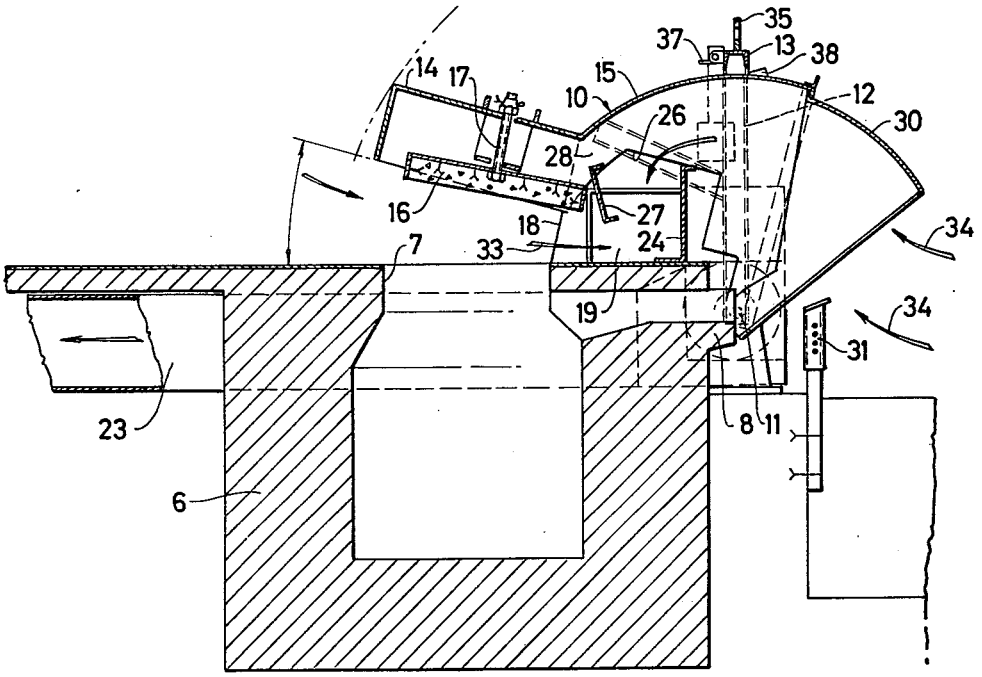

FIGS. 3 and 8 show the hood 10 raised to an angular position rendering the charging orifice accessible from one side to permit certain operations (slag removal, skimming, charging). Smoke and gases flowing upwards out of the charging orifice are caught by the hood part 14 and carried away by a current of air flowing towards the port 19 through the slot 28 in front of the baffle strip 27 as well as through the space (at the arrow 33) between the lower edge of the baffle strip 27 and the platform. The sheet metal members 18 contribute to this effect by causing the current of air to pass above the part of the surface of the platform which is adjacent to the charging orifice, whereby an effective removal of the smoke or fumes leaving the charging orifice is effected. Some air is caused to flow also through the hood 30 and the hood portion 15 (the arrows 34). Said last mentioned current is smaller than the one resulting when the hood is in its bottom position. This is allowable and indeed desirable, as a small part only of the smoke or gases from the furnace will escape through the pouring orifice when the lid 16 is off.

Figure 4:
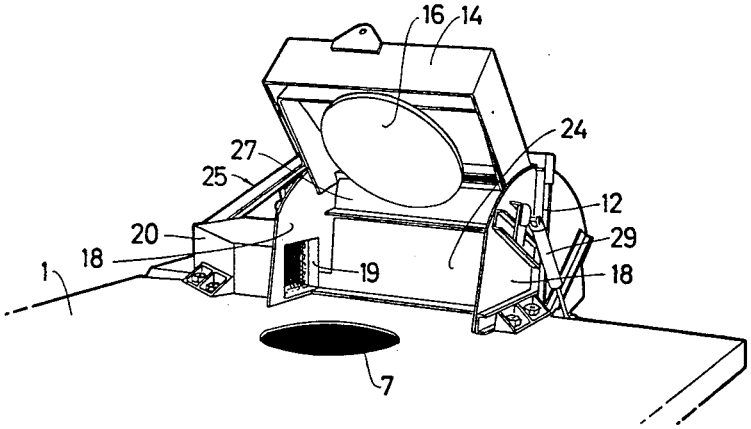
Figure 5:
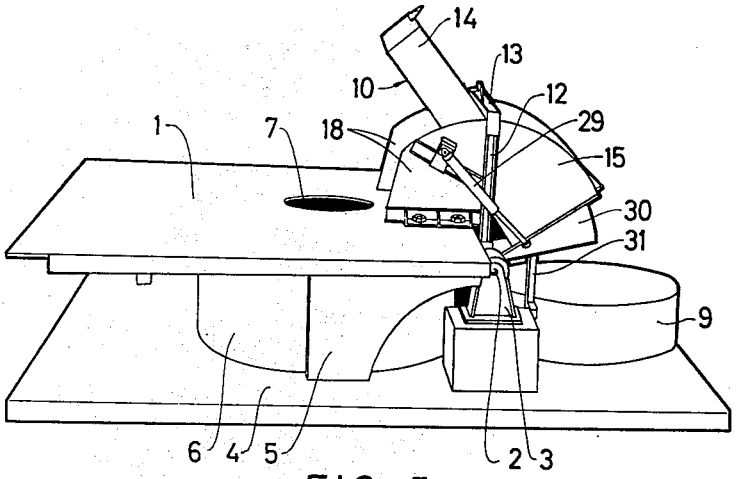
Figure 9:
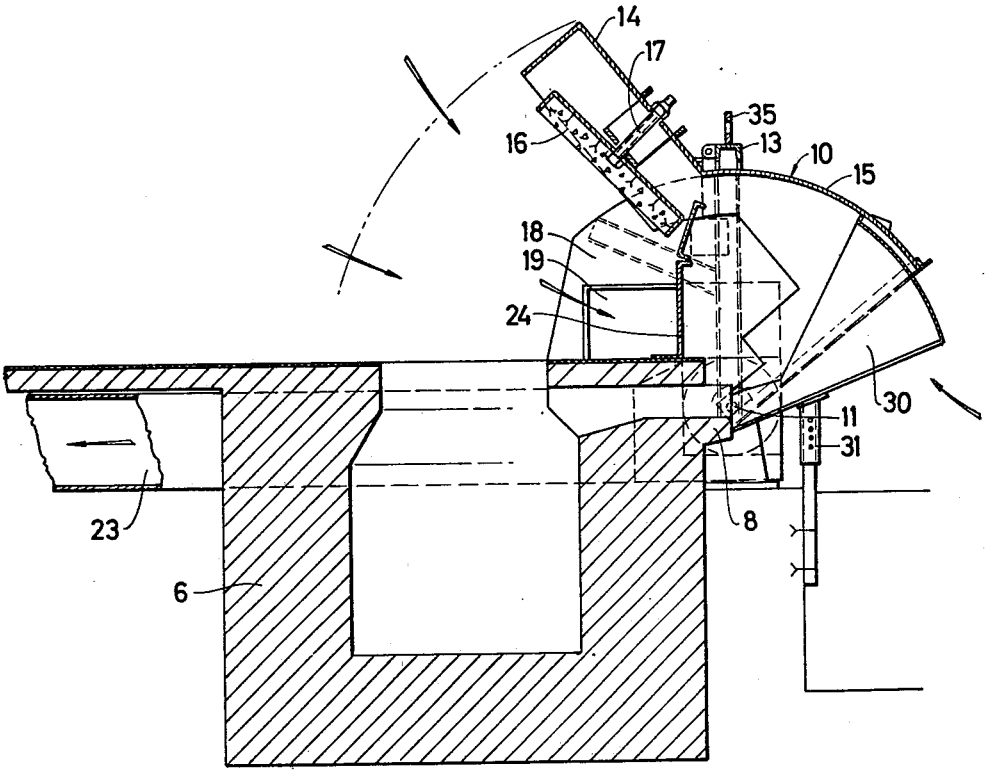

In FIGS. 4, 5 and 9 the hood 10 is raised to its top position to allow bucket charging of the furnace. The sheet metal members 18 and the part 14 of the hood 10 together form a cowl facing the charging orifice, said cowl together with the upper surface of the platform delimiting a space tapering towards the suction port 19. An effective scouring of this space demands a stronger current of air than the one required at smaller tilt angles of the hood. To satisfy this demand, the baffling strip 27 of the hood in the position shown forms an extension of the baffling plate 24, whereby the interior of the hood portion 15 now communicates with the suction port 19 through the comparatively narrow slot 28 only, so that a small part only of the total current of air is caused to maintain a weak influx of air through the hood part 15 and the hood 30, said latter hood now occupying the bottom position determined by the stop members 31.

Figure 6:
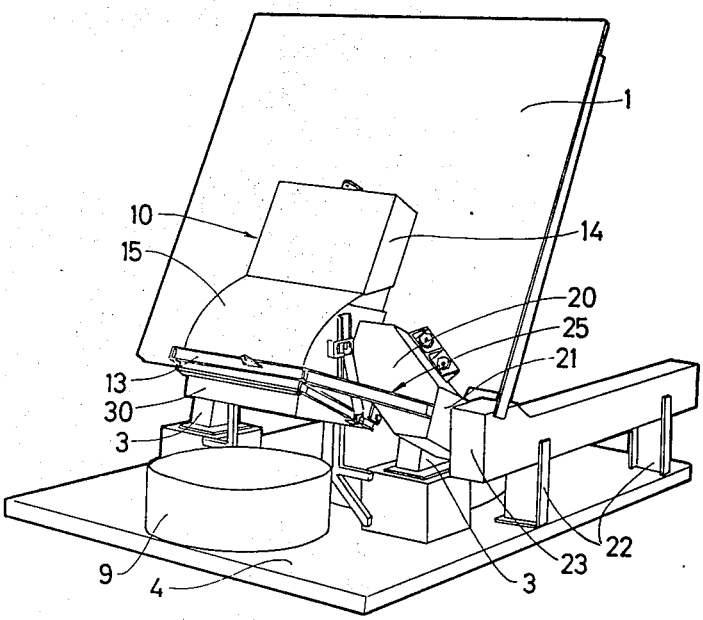

In FIGS. 6 and 10, the platform 1 is shown in a tilted position at the end of a pouring period. The tilting angle shown in FIG. 10 is the largest tilting angle normally used, as a certain quantity of molten metal usually has to be left at the end of the pouring period in order to facilitate starting of the melting of the next charge. The hood is in its bottom position with reference to the platform, so that all of the current of air passing through the air ducts (apart from the small current leaking in between the edges of the hood and the platform) is sucked in towards the hood portion 15 or the hood 30 which during the pouring operation is gradually pushed into the hood part 15, said hood portion and hood thus effectively catching the smoke emerging from the liquid metal discharged from the furnace.

Both ends of the yoke member 13 are provided with a bearing for a pendulum member 36 depending at the outside of the sheet metal member 18. Said pendulum member is provided with a projection 37. The angular displacement of the pendulum member with respect to the frame caused by tilting of the platform causes said projection to obstruct a projection 38 provided on the hood part 15 and thereby to lock the hood 10 in the position shown. The hood therefore will remain stationary in the position shown with reference to the platform even if the supply of compressed air to the cylinders 29 should fail during tilting of the platform.

The invention is not limited to the embodiment above described and shown on the drawings, but comprises any apparatus within the scope of the appended claims.

I claim:

1. Apparatus for collecting and removing smoke and fumes from a melting furnace plant comprising: a platform tiltably supported by stationary supporting members, the tilting axis being near one edge of the platform, a furnace rigidly connected to the platform, said furnace having a furnace chamber open at the top and accessible through a charging orifice in the platform, said furnace having a pouring spout connected to the upper part of the side wall of the furnace and located near the tilting axis;

(a) a hood pivotably supported by supporting members attached to said platform, said hood being angularly movable towards and away from a portion of the platform thereby surrounding the charging orifice of the platform in its lowered position, the pivot axis of said hood being parallel with the tilting axis of the furnace and extending at the same side of the furnace as said tilting axis, (b) a pair of parallel wall members arranged on the upper surface of said platform and extending at right angles to said tilting axis, said wall members extending from the edge of the platform which is near the tilting axis along the platform and having such a vertical extension with respect to the plane of the platform as in any angular position of said hood, the hood together with said wall members and with the upper surface of the platform define a cowl facing said charging orifice, (c) a first air duct attached to said platform, (d) a second air duct supported by stationary supporting members, said first air duct having an inlet orifice connected to said cowl and an outlet orifice surrounding said tilting axis, said outlet orifice being connected to and freely rotatable with respect to an inlet orifice of said second air duct, (e) the end of said hood which is nearest to the pivotal axis of the hood forms a second cowl, the orifice of which is located, when said hood is in its bottom position with reference to the platform, near a vertical plane through the pivot axis of the hood, and, (f) a second hood adapted to said orifice of the second cowl and arranged to be angularly displaceable into and out of said first mentioned hood, said second hood being pivotal about the axis of said first hood.

2. Apparatus according to claim 1, wherein said inlet orifice is constituted by a port in one of said wall members.

3. Apparatus according to claim 1 including a baffle plate arranged between said wall members in close juxtaposition to the platform near the edge of the platform which is nearest to the tilting axis, said baffle plate serving to limit the influx of air into said cowl from the side of the cowl facing away from the charging orifice.

4. Apparatus according to claim 3 wherein said hood is provided with an inner baffle arranged in a determined upper angular position of said hood adjacent to the upper edge of said baffle plate whereby its throttling action is increased.

5. Apparatus according to claim 4 wherein said inner baffle is arranged in such a way as to make the lower edge of said inner baffle in the lower position of said hood closely adjacent to a part of the platform located between said charging orifice and said edge of the platform.

6. Apparatus according to claim 1 including a lid for the charging orifice supported within said hood by means of a member admitting a free adaption of the lid to its support on the platform.

7. Apparatus according to claim 1 wherein the height of the lowered hood above the plane of the platform decreases from a maximum at said orifice of the second cowl towards the part of the hood covering the charging orifice.

8. Apparatus according to claim 1 wherein a part of the hood connected to said orifice has two plane walls which are parallel to the pair of wall members provided on the platform, each of said walls being movable along the inside of one of said wall members, and a cylinder sector shaped wall portion connecting said side walls to each other, the axis of said cylinder sector shaped portion coinciding with the pivot axis of the hood.

9. Apparatus according to claim 1 wherein the pivot axis of said hood at least approximately coincides with the tilting axis of the platform.

10. Apparatus according to claim 1 wherein said second hood comprises a pair of side walls parallel with the plane side walls of said first hood, and cylinder sector shaped wall portion concentrical to the cylinder sector shaped wall portion of said first hood.

11. Apparatus according to claim 1 wherein at least one stop member is arranged on a stationary base to limit the angular displacement outwards of said second hood with respect to a vertical plane.

12. Apparatus according to claim 1 including a frame detachably attached to said platform, said two wall members, said first air duct, bearing means for said hood and motor means for the angular displacement of the hood being mounted on said frame.

13. Apparatus according to claim 12 wherein the outlet end of said first air duct and the inlet end of said second air duct are each provided with a wall at right angles to the tilting axis, each of said walls being provided with an orifice surrounding the tilting axis.

* * * * *